US012078355B2

(12) United States Patent
Burbaum

(10) Patent No.: US 12,078,355 B2
(45) Date of Patent: Sep. 3, 2024

(54) RESONATOR RING, METHOD AND BASKET

(71) Applicant: Siemens Energy Global GmbH & Co. KG, Bayern (DE)

(72) Inventor: Bernd Burbaum, Falkensee (DE)

(73) Assignee: Siemens Energy Global GmbH & Co. KG, Bayern (DE)

( * ) Notice: Subject to any disclaimer, the term of this patent is extended or adjusted under 35 U.S.C. 154(b) by 0 days.

(21) Appl. No.: 18/034,686

(22) PCT Filed: Oct. 5, 2021

(86) PCT No.: PCT/EP2021/077413

§ 371 (c)(1),
(2) Date: Apr. 29, 2023

(87) PCT Pub. No.: WO2022/096210

PCT Pub. Date: May 12, 2022

(65) Prior Publication Data

US 2023/0400185 A1 Dec. 14, 2023

(30) Foreign Application Priority Data

Nov. 4, 2020 (DE) ..... 10 2020 213 836.2

(51) Int. Cl.
*F23R 3/00* (2006.01)
*F23R 3/46* (2006.01)

(52) U.S. Cl.
CPC ..... *F23R 3/46* (2013.01); *F23R 3/002* (2013.01); *F23R 2900/00014* (2013.01)

(58) Field of Classification Search
CPC .. F23R 2900/00014; F23R 2900/03041; F23R 2900/03042; F23R 2900/03043;
(Continued)

(56) References Cited

U.S. PATENT DOCUMENTS 6,530,971 B1 3/2003 Cohen
8,469,141 B2 6/2013 Wang
(Continued)

FOREIGN PATENT DOCUMENTS

DE 102013204307 A1 9/2014
EP 2739905 B1 7/2018
(Continued)

OTHER PUBLICATIONS

PCT International Search Report and Written Opinion of International Searching Authority mailed Jan. 14, 2022 corresponding to PCT International Application No. PCT/EP2021/077413 filed Oct. 5, 2021.

*Primary Examiner* — William H Rodriguez
(74) *Attorney, Agent, or Firm* — Wolter Van Dyke Davis, PLLC

(57) ABSTRACT

A resonator ring for a combustor basket, in particular for a gas turbine power plant, which has at least one ring, wherein the ring or the rings has or have apertures, wherein insert plates are connected to the ring or the rings within the aperture. A method for producing a resonator ring, in which a ring or rings is or are produced from a first metal, then insert plates made of a, preferably cast, second material are connected to the ring or the rings, and individual resonator boxes are produced.

12 Claims, 3 Drawing Sheets

(58) Field of Classification Search
CPC . F23R 2900/03044; F23R 2900/00018; F23M 5/085; F04D 29/663; F04D 29/665; B64D 2033/0206; F02C 7/045; F02K 1/827
See application file for complete search history.

(56) References Cited

U.S. PATENT DOCUMENTS

| | | | | |
|---|---|---|---|---|
| 9,395,082 | B2 | 7/2016 | Tiwary | |
| 10,088,163 | B2 | 10/2018 | Beck | |
| 10,578,305 | B2 | 3/2020 | Deiss | |
| 2005/0034918 | A1* | 2/2005 | Bland | F23M 20/005 181/266 |
| 2007/0125089 | A1 | 6/2007 | Sattinger | |
| 2011/0138812 | A1* | 6/2011 | Johnson | F23R 3/00 60/725 |
| 2011/0302924 | A1* | 12/2011 | Lee | F02K 1/822 60/752 |
| 2012/0006028 | A1* | 1/2012 | Lee | F23R 3/06 60/725 |
| 2012/0036858 | A1 | 2/2012 | Lacy | |
| 2012/0102963 | A1 | 5/2012 | Corr | |
| 2012/0137690 | A1* | 6/2012 | Sardeshmukh | F23R 3/002 60/725 |
| 2012/0198854 | A1* | 8/2012 | Schilp | F23R 3/06 60/755 |
| 2013/0008167 | A1* | 1/2013 | Akamatsu | F02C 7/24 60/725 |
| 2013/0037345 | A1* | 2/2013 | Wang | F02C 7/24 181/204 |
| 2013/0074471 | A1* | 3/2013 | Khan | F23R 3/06 60/722 |
| 2013/0074501 | A1* | 3/2013 | Tiwary | F01N 1/023 29/889.22 |
| 2013/0160453 | A1* | 6/2013 | Kimura | F23R 3/06 60/725 |
| 2014/0116059 | A1 | 5/2014 | Benz | |
| 2014/0150435 | A1 | 6/2014 | Maurer | |
| 2014/0238029 | A1* | 8/2014 | Sutcu | F23R 3/06 60/754 |
| 2015/0020498 | A1* | 1/2015 | Schilp | F23R 3/002 60/39.83 |
| 2016/0334102 | A1* | 11/2016 | Johnson | F23R 3/002 |
| 2017/0227220 | A1* | 8/2017 | Schilp | F23R 3/002 |
| 2017/0227223 | A1* | 8/2017 | Deiss | F23R 3/10 |
| 2017/0268777 | A1* | 9/2017 | Hase | F23R 3/002 |
| 2017/0276350 | A1 | 9/2017 | Schilp et al. | |
| 2018/0313540 | A1 | 11/2018 | Nagaraja | |
| 2019/0128521 | A1* | 5/2019 | Han | F02C 7/222 |
| 2019/0255617 | A1* | 8/2019 | Pardhi | B33Y 10/00 |
| 2020/0232357 | A1* | 7/2020 | Bertoldi | F01N 1/023 |
| 2020/0333001 | A1 | 10/2020 | Dyszkiewicz | |

FOREIGN PATENT DOCUMENTS

| | | | | |
|---|---|---|---|---|
| EP | 3134682 | B1 | 8/2018 | |
| WO | WO-2019018673 | A1 * | 1/2019 | F01D 25/04 |

* cited by examiner

RESONATOR RING, METHOD AND BASKET

CROSS REFERENCE TO RELATED APPLICATIONS

This application is the US National Stage of International Application No. PCT/EP2021/077413 filed 5 Oct. 2021, and claims the benefit thereof. The International Application claims the benefit of German Application No. DE 10 2020 213 836.2 filed 4 Nov. 2020. All of the applications are incorporated by reference herein in their entirety.

FIELD OF INVENTION

The invention relates to a resonator ring, its production method and a combustor basket.

BACKGROUND OF INVENTION

In combustion systems of gas turbines, cracks in holes of resonator boxes of a resonator ring can occur on account of cyclic LCF (low cycle fatigue) loading.

A combustor basket of this kind is disclosed in EP 2 739 905 B1.

SUMMARY OF INVENTION

It is therefore the object of the invention to solve the problem mentioned above.

The object is achieved by a resonator ring, by a method and by a combustor basket as claimed.

The respective dependent claims list further advantageous measures which can be combined with one another as desired in order to achieve further advantages.

Crack initiation can be avoided by locally reinforcing a hole geometry of a resonator box of a resonator ring with a γ'-strengthened nickel-based superalloy.

A ring for the resonator ring can be manufactured conventionally, but also generatively, in particular from a nickel-based wrought alloy, in particular from HASTELLOY® X (UNS N06002 (W86002)) nickel-based wrought alloy or HAYNES® 282® (UNS N07208) nickel-based wrought alloy, by Haynes International, Inc.

Insert plates for the hole geometry are produced from γ'-strengthened nickel-based superalloy for local reinforcement, in particular from IN-738 (UNS N07738) nickel-based superalloy, Alloy 247 nickel-based super alloy, or RENE® 80 nickel-based superalloy.

The insert plates are, in particular, cast and, in particular, are also produced from plates by erosion.

Insertion, in particular insertion involving positive engagement, of the insert plates into the ring is preferably accomplished by welding, in particular with IN625, or preferably by soldering.

A combustor basket is then produced according to the prior art, in particular by welding.

Advantages of the invention are:

Avoidance of crack initiation in the resonator ring,

Thicknesses of the insert plates can be made thinner: this allows for different bore diameters, a different number of holes and thus savings in cooling air, Longer life and lower costs.

DETAILED DESCRIPTION OF INVENTION

Figure 1:
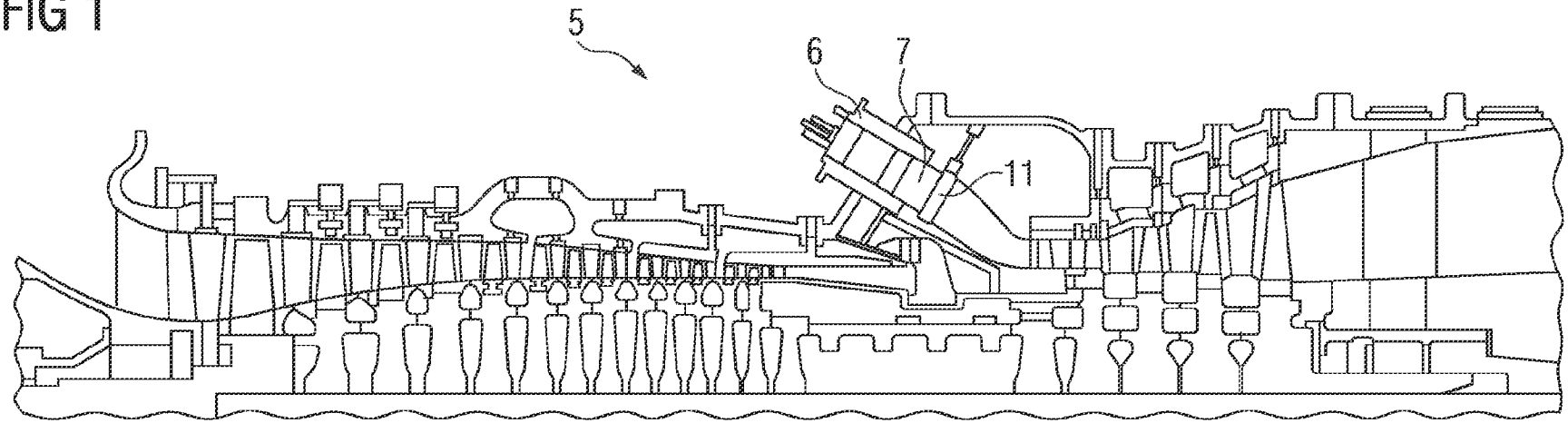
FIG. 1 shows a view of a gas turbine power plant with a combustor basket.

FIG. 1 shows a view of a gas turbine power plant 5.

A combustion chamber 6 is located in a combustor basket 7.

Figure 2:
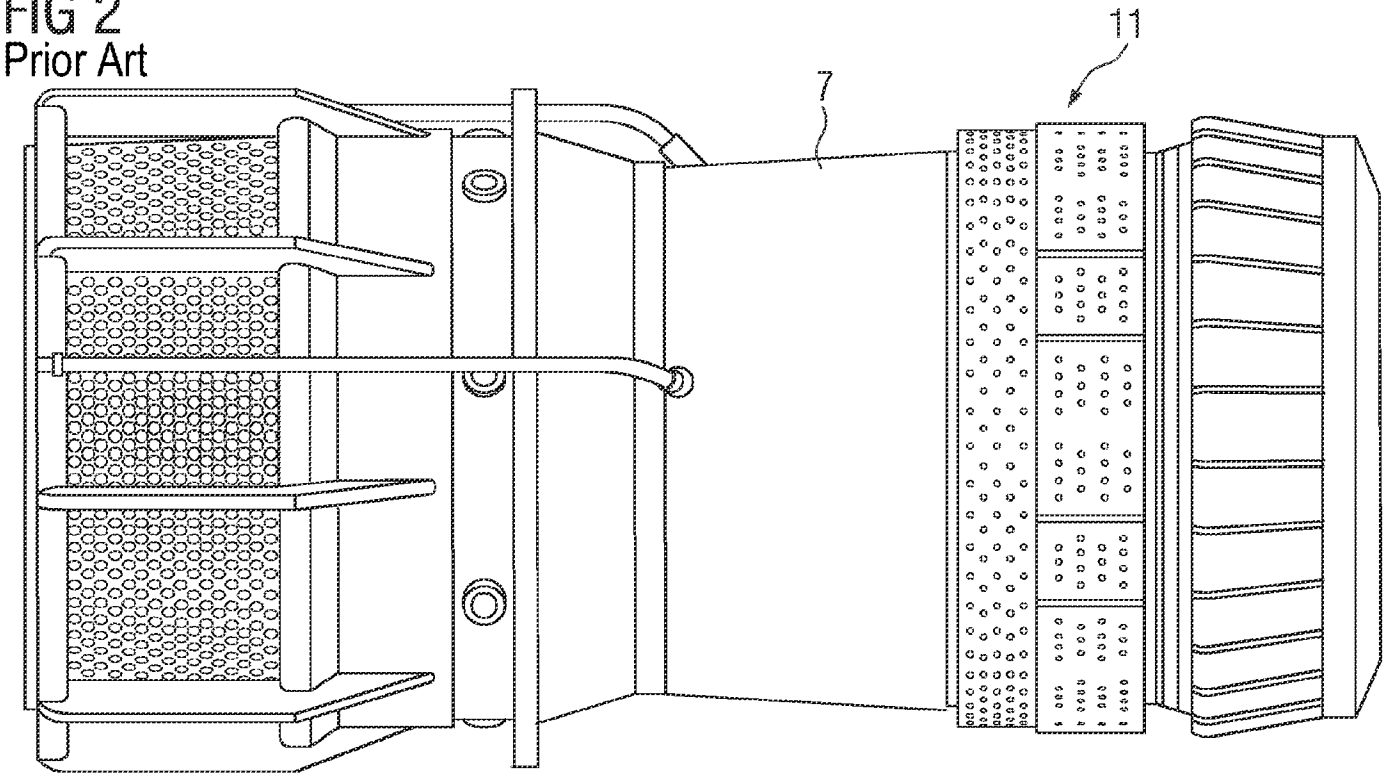
FIG 2 Prior Art
FIG. 2 shows a view of a combustor basket with resonator rings according to the prior art.

FIG. 2 shows a close-up view of the combustor basket 7 and a resonator ring 11.

The combustion chamber 6 produces combustion products which are conducted downstream through the combustor basket 7 and the resonator ring 11 into a transition system. From there, hot combustion products flow downstream to a turbine part and can be used for power generation.

The resonator ring 11 is capable of controlling or absorbing various acoustic frequencies generated by the combustion chamber 6 during the operation of the gas turbine power plant 5.

Figure 3:
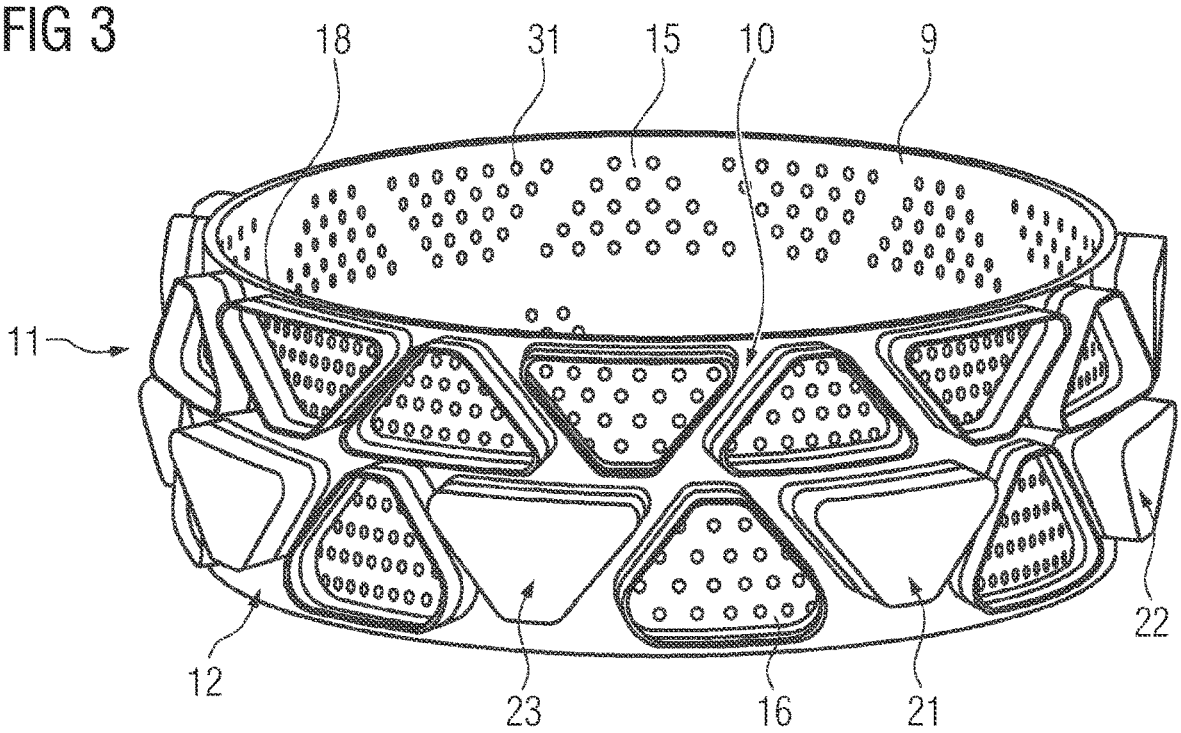
FIG. 3 shows a resonator ring in detail.

FIG. 3 shows in detail a resonator ring 11 of the kind used in a gas turbine power plant 5.

The resonator ring 11 has a ring 10, preferably two interconnected rings 9, 12, which in turn can also each consist of half-rings.

The rings 9, 12 for the resonator ring 11 can also be of integral design, i.e. can form a ring 10.

The ring 10 or the rings 9, 12 is or are preferably round or oval in cross section with respect to the through-flow direction or are matched to the combustion system.

The ring 10 or the rings 9, 12 each have on their circumferential surface a plurality of resonator boxes 21, 22, which are preferably uniformly distributed there around the circumference.

The base surfaces of the resonator boxes 21, 22 are trapezoidal regions 15, 16, in particular in the form of isosceles regions, which are arranged alternately in the circumferential direction with the base side of the trapezoid facing downward or upward.

The regions 15, 16 are distributed around the entire circumference of the ring 10 or of each of the rings 9, 12.

The regions 15, 16 have almost the height of the height of a ring 9, 10.

On the outside of the ring 10 or the rings 9, 12, there is in each case a frame 18 corresponding to the trapezoidal region 15, 16 around the respective regions 15, 16, which frame then forms a closed box with a corresponding closing cover 23 and thus forms resonator boxes 21, 22.

The frame 18 and the cover 23 for the resonator boxes 21, 22 can also be formed jointly in an integral manner.

Within the, in particular trapezoidal, regions 15, 16, there are holes 31 which, in cooperation with the resonator box 21, 22, are used for damping or for frequency control.

Furthermore, the resonator ring 11 described here, consisting of ring 10 or rings 9, 12 and resonator boxes 21, 22 according to the invention, is to be improved and produced more effectively.

According to the invention, in the region shown in FIG. 3, where the holes 31 according to the prior art (FIG. 3) are present or formed directly in the ring 10 or the rings 9, 12, there is a complete aperture 24 (FIG. 4), which is likewise of trapezoidal design.

Figure 4:
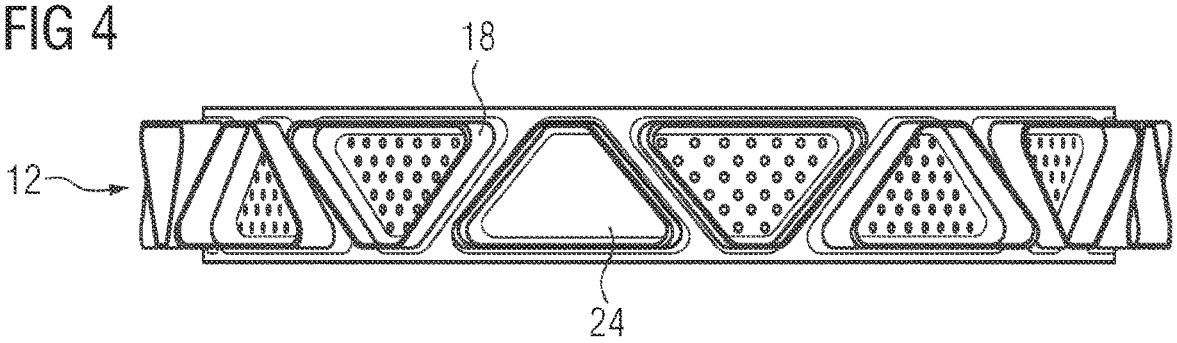
FIG. 4 shows a resonator ring according to the invention.

FIG. 4 is a representative example of a ring 9 or 12 or 10 according to FIG. 3.

Figure 5:
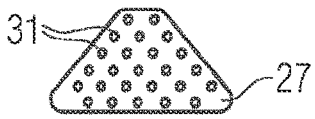
FIG. 5 shows an insert plate with holes.

Accordingly, an insert plate 27 (FIG. 5) is inserted into this aperture 24, the shape of which 27 is complementary thereto.

The insert plate 27 is preferably produced by casting.

The insert plate 27 is inserted into the aperture 24 and connected, in particular soldered, to the ring 10, 9, 12.

The insert plate 27 and the ring 10 or rings 9, 12 can in particular also additionally have a positive connection.

The holes 31 of respective insert plates are preferably of different sizes in order to cover different frequency ranges.

The holes 31 are preferably uniformly distributed within the trapezoidal region 15, 16 of the insert plate 27.

The resonator boxes 21, 22 are then formed from the surrounding frame 18 and cover 23 in a known manner or by some other procedure to give the resonator boxes 21, 22.

The materials of the ring 10 or rings 9, 12 and the insert plates are different.

Different means that the materials differ in having at least one alloy element more or at least one alloy element less and/or that a proportion of at least one alloy element differs by at least 10%, in particular by at least 20%.

The material of the insert plates 27 is preferably a γ'-strengthened nickel-based alloy, in particular such as IN738, Alloy 247 or Rene 80.

The insert plates 27 or also the holes 31 are preferably produced by erosion from cast plates.

Owing to the higher strength of the insert plates 27, they can be made thinner and allow other bore diameters (=holes 31), thereby saving cooling air.

Thus, for example, a first insert plate has all holes with a first diameter and a second insert plate has holes with a second diameter, the difference between the holes being at least 10%.

The invention claimed is:

1. A resonator ring for a combustor basket, comprising:

a ring comprising an annular array of plate-shaped apertures, a respective plate-shaped insert plate connected to the ring within each plate-shaped aperture of the annular array of plate-shaped apertures, and a respective box comprising a frame and a cover disposed over each plate-shaped insert plate and separately secured to the ring, wherein an inner perimeter of the frame is set apart from an outer perimeter of the plate-shaped insert plate by a portion of the ring that is disposed therebetween and that encircles the plate-shaped insert plate, wherein materials of the ring and the insert plates are different, and wherein the ring is produced from a nickel-based wrought alloy.

2. The resonator ring as claimed in claim 1, wherein the insert plates have holes of different sizes.

3. A Combustor basket comprising:

a resonator ring as claimed in claim 1.

4. The resonator ring as claimed in claim 1, wherein the combustor basket is for a gas turbine power plant.

5. The resonator ring as claimed in claim 1, wherein the insert plate is produced from a γ'-strengthened nickel-based alloy.

6. The resonator ring as claimed in claim 1, wherein the insert plate is a cast insert plate.

7. A method for producing a resonator ring, comprising:

producing a ring from a first metal, wherein the ring comprises an annular array of plate-shaped apertures, securing in place a respective plate-shaped insert plate made of a second material in each plate-shaped aperture of the annular array of plate-shaped apertures, and forming respective resonator boxes by then securing a respective frame and a respective cover to the ring over each insert plate such that an inner perimeter of the frame is set apart from an outer perimeter of the plate-shaped insert plate by a portion of the ring that is disposed therebetween and that encircles the plate-shaped insert plate.

8. The method as claimed in claim 7, wherein the insert plates are produced from cast plates.

9. The method as claimed in claim 7, wherein the ring is produced from a nickel-based wrought alloy.

10. The method as claimed in claim 7, wherein the insert plate is produced from a material different from that of the ring.

11. The method as claimed in claim 10, wherein the insert plate is produced from a γ'-strengthened nickel-based alloy.

12. The method as claimed in claim 7, wherein the insert plates and/or holes in the insert plates are produced by eroding plates.

* * * * *